US005483894A

United States Patent [19]

Facciano et al.

[11] Patent Number: 5,483,894

[45] Date of Patent: Jan. 16, 1996

[54] INTEGRAL MISSILE ANTENNA-FUSELAGE ASSEMBLY

[75] Inventors: Andrew B. Facciano, Tucson; Ronald N. Hopkins, Superior Township; Rodney H. Krebs, Tucson; James L. Neumann, Tucson; Oscar K. Ohanian, Tucson, all of Ariz.

[73] Assignee: Hughes Missile Systems Company, Los Angeles, Calif.

[21] Appl. No.: 364,905

[22] Filed: Dec. 27, 1994

[51] Int. Cl.[6] ..... F42B 15/36

[52] U.S. Cl. ..... 102/293; 102/377

[58] Field of Search ..... 102/293, 377, 102/473, 374

[56] References Cited

U.S. PATENT DOCUMENTS

| | | | |
|---|---|---|---|
| 4,485,740 | 12/1984 | Boss | 102/293 |
| 4,665,792 | 5/1987 | Gassler et al. | 102/293 |
| 5,103,734 | 4/1992 | Arnaud et al. | 102/377 |
| 5,394,803 | 3/1995 | Mort | 102/377 |

*Primary Examiner*—Charles T. Jordan
*Assistant Examiner*—Theresa M. Wesson
*Attorney, Agent, or Firm*—Charles D. Brown; Randall M. Heald; Wanda K. Denson-Low

[57] ABSTRACT

An integral missile antenna-fuselage assembly (50) is provided for integration into an armament missile (12) which carries primary missile loads, houses internal electronic assemblies, provides mounting surface zones for external sensor antennas (71) , and protects sensitive antenna components from supersonic aerodynamic heating. Each end of the fuselage assembly (50) is formed from a fastener ring (52,54) having a circumferential recess (84,86) which receives a filament wound main structure (60) to form the missile fuselage tube. Preferably, a titanium liner (58) is first joined to each fastener ring with a step-lap joint (94,96) along which it is adhesively bonded. The liner (58) and adjacent fastener ring portions (52,57) provide a mandrel on which a graphite/Bismaleimide (BMI) resin pre-preg is filament wound and co-cured to form the integral fuselage (60). A plurality of Graphite/BMI doublers (62,63,64,65) are axisymmetrically positioned on the fuselage external surface to form four antenna cavities (66,67,68,69) which receive antennas (71) therein. Subsequently, antenna spacers (72, 73,74,75) encase the antennas (71) about which a radome overwrap (70) is filament wound with a Quartz/BMI prepreg. The entire structure (70) is then integrally cured to the internal fuselage (60) and antenna spacers (72,73,74,75) afterwhich it is surface treated (76) and overcoated (78).

19 Claims, 4 Drawing Sheets

INTEGRAL MISSILE ANTENNA-FUSELAGE ASSEMBLY

BACKGROUND OF THE INVENTION

1. Technical Field

This invention relates generally to a fuselage construction for an armament missile and, more particularly, to an integral missile antenna-fuselage assembly.

2. Discussion

Aft fuselage assemblies for use in constructing multiple section armament missiles are known in the art which function doubly as a primary structural member and a missile antenna housing. To this end, armament missiles are generally constructed from a plurality of joined-together sections. Each intermediate section includes a pair of fastener joints provided one at each end of a cylindrical section skin to form a missile section. Typically, an armament missile from tip-to-tail has a guidance section, an armament section, a propulsion section, and a control section. The aft end of the guidance section is further sub-divided to include an aft fuselage which joins the guidance section to the armament section.

Accordingly, the aft fuselage section must carry primary vehicle loads through the missile air frame in between the guidance section and armament section. Likewise, the aft fuselage section must house antenna components which form part of the guidance section to control the missile in-flight.

It is therefore desirable to provide an improved aft fuselage for the guidance section of an Advanced Medium Range Air-to-Air Missile (AMRAAM), or guided missile which reduces cost and simplifies manufacturing through part consolidation. In addition, it is further desirable to eliminate a secondary process presently utilized for incorporating antenna components onto a missile surface. In particular, it is desirable to eliminate secondary steps in incorporating an antenna in the fuselage, consolidating common features from the fuselage, and integrating fabrication steps which simplify the fuselage design and streamline its production. It is further desirable to enhance product reliability and repeatability. Other further desirable features include improving material efficiency to obtain a greater air frame capability as a missile structure and as an antenna radome.

SUMMARY OF THE INVENTION

In accordance with the teachings of the present invention, an Integral Missile Antenna-Fuselage Assembly (IMAFA) is provided which is designed to carry primary missile loads, house internal electronic assemblies, provide mounting surface zones for external sensor antennas, and protect sensitive antenna components from supersonic aerodynamic heating. The antenna-fuselage assembly includes a structural joint which joins together a pair of fastener rings at opposite ends of a filament wound main structure to form a missile fuselage tube. A titanium liner is preferably first joined to each fastener ring with a scarf joint along which it is adhesively bonded. The liner and an adjacent flange portion on each fastener ring form a mandrel on which a Graphite/Bismaleimide (BMI) resin pre-preg is filament wound and co-cured to form an integral fuselage therebetween. A radially inwardly extending circumferential recess provided on each fastener ring rim receives a filament winding therein which traps the integral fuselage to each fastener ring subsequent to curing. In a preferred embodiment, the integral fuselage is co-cured with four uni-directional Graphite/BMI doublers which are axisymmetrically positioned on the external surface to form four Target Detection Device (TDD) antenna cavities which receive antennas therein. Subsequently, four antenna spacers enclose the antennas to form an external cylindrical surface thereabout. Finally, a radome overwrap is filament wound with Quartz/BMI prepreg which is subsequently integrally cured to the internal fuselage and antenna spacers and post cured prior to surface treatment with polyurethane paint overcoat.

BRIEF DESCRIPTION OF THE DRAWINGS

Other objects and advantages of the present invention will become apparent to those skilled in the art upon reading the following detailed description and upon reference to the drawings in which.

FIG. **8*a* is a cross-sectional view taken along line 8—8 of FIG. 2 depicting the prior aft-fuselage at the location of the electronics unit assembly.

DETAILED DESCRIPTION OF THE PREFERRED EMBODIMENT

Figure 1:
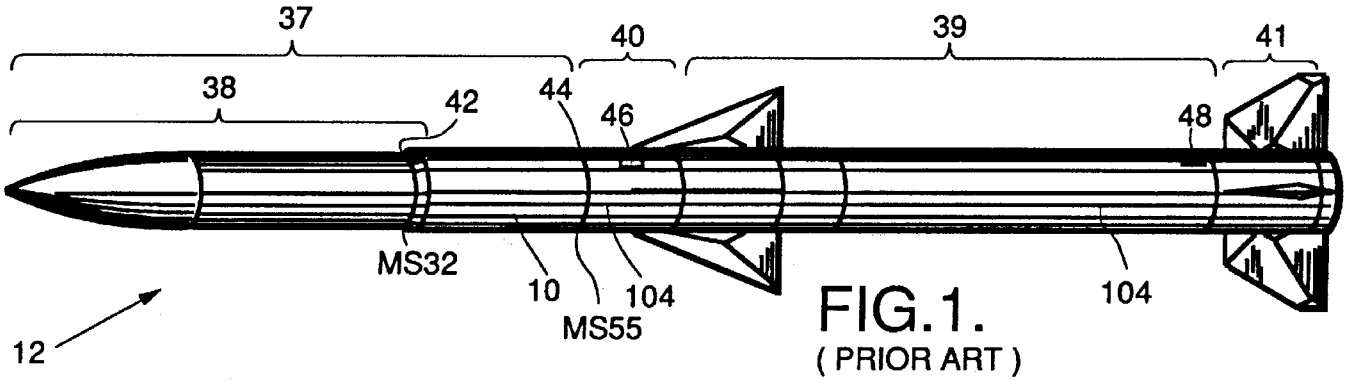
FIG. 1. ( PRIOR ART )
FIG. 1 is a perspective view of an AMRAAM, or guided missile with a prior art aft fuselage dome assembled in the missile.
Figure 2:
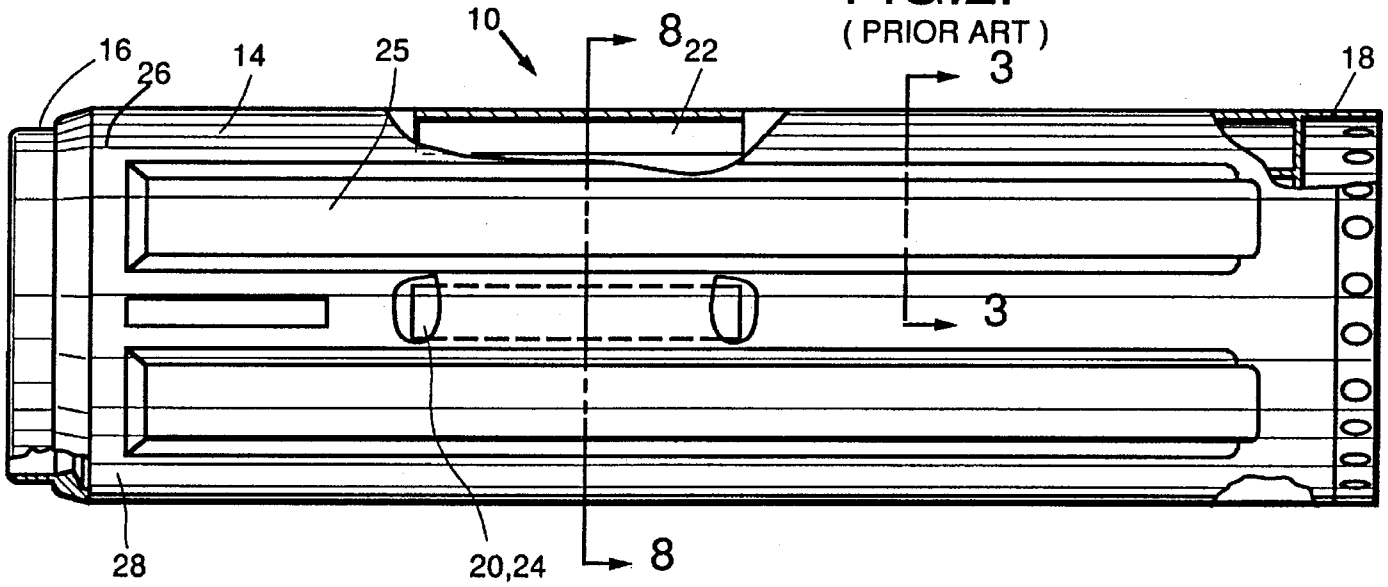
FIG. 2. ( PRIOR ART )
FIG. 2 is a vertical side view with portions shown in breakaway of the prior art aft-fuselage as shown in FIG. 1 without the overwrap and TDD antennas.

An existing Guidance Section (GS) aft-fuselage 10 for the Advanced Medium Range Air-to-Air Missile (AMRAAM) 12 is provided in FIG. 1 in accordance with the prior art. The prior art aft fuselage 10 as shown in FIG. 2 is constructed and assembled with three cylindrical subcomponents 14, 16, 18 having doubler reinforcements 20, 22, 24 therealong. The first subcomponent is an aft fuselage skin 14 formed from a sheet of titanium which forms the walls of the fuselage. A forward flange 16 is machined from bars of annealed titanium to define a first end of the fuselage. Art aft housing 18 is formed from a titanium investment cast structure to define the opposite end of the fuselage. Aft fuselage skin 14 is preferably formed in two halves which are subsequently joined together to define a cylinder having longitudinal surface cavities 25 stamped therein for supporting Target Detection Device (TDD) antennas.

According to the prior art, the aft fuselage skin is formed in two halves by a pair of mating skin sections 26 and 28 which are welded together along their longitudinal seams. Furthermore, the forward flange 16 and aft housing 18 are circumferentially electronbeam welded to opposite ends of the fuselage skin. However, to ensure weld integrity full radiographic and ultrasonic inspections must be made of each weld, and the entire structure must be helium leak tested.

Furthermore, the plurality of doublers 20, 22, 24 formed from titanium sheet metal are spot welded to the fuselage skin 14 in-between the antenna cavities 25 for reinforcement purposes. Accordingly, all the aforementioned welds must be heat treated to a temperature of approximately 1,100° F. for about 120 minutes in order to relieve stresses in the welds.

Figure 3:
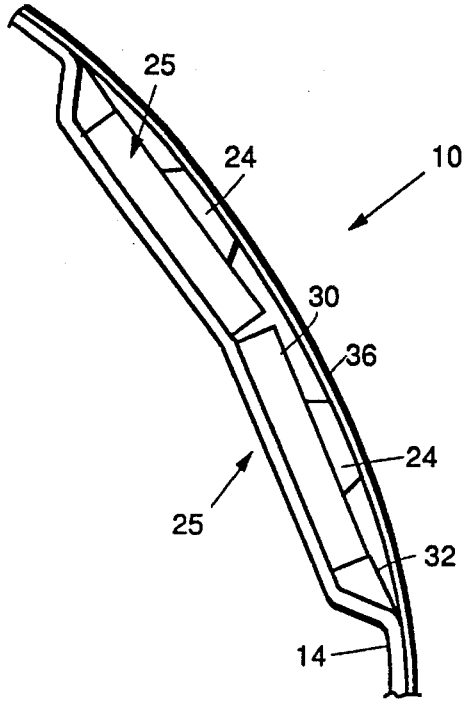
FIG. 3. ( PRIOR ART )
FIG. 3 is a partial sectional view of the prior art aft-fuselage taken generally along 3—3 of FIG. 2 including the overwrap and TDD antennas.
Figure 8A:
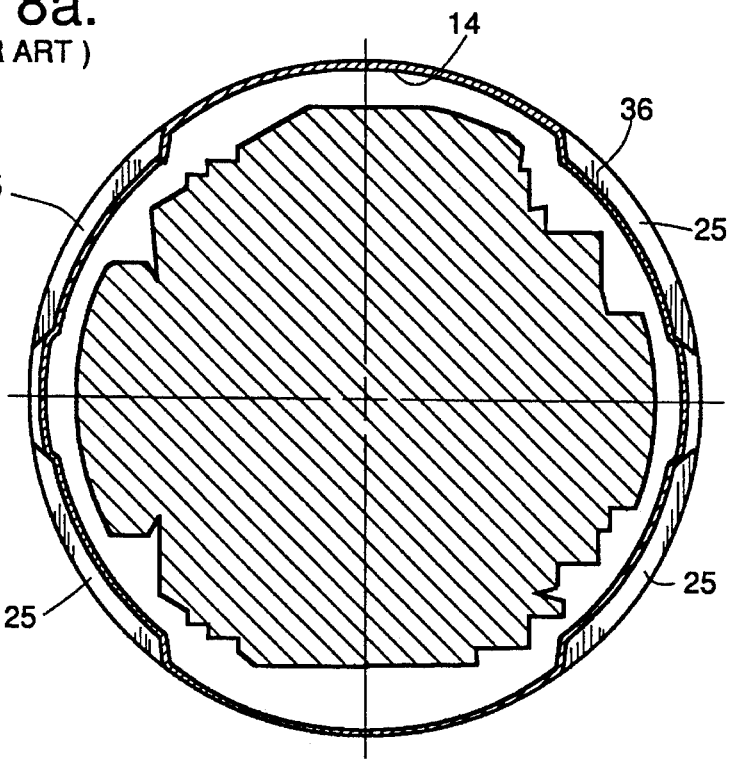
FIG. 8a. ( PRIOR ART )
FIG. 8*b* is a cross-sectional view corresponding with that shown in FIG. 8*a* depicting the aft-fuselage of FIG. 4** in cross-section.

Following welding and heat treating of the prior art AMRAAM aft fuselage section 10, eight TDD antennas 30 with coax cable connectors are installed into the skin cavities 25 with Kapton tape 32 manufactured by DuPont de Nemours, E. I., & Co., Inc. As shown in FIG. 3, a QUARTZ/POLYIMIDE (Qz/PI) spacer 24 is then positioned over the antennas using Kapton tape in order to complementarily shape the fuselage skin into an external cylindrical shape. As shown in FIG. 8*a* the fuselage and antenna assembly is then wet wound with a Qz/PI overwrap 36. However, this technique is very labor intensive, complex to process, and very costly per unit section. Furthermore, internal pressurization during helium leak testing has been difficult to maintain when using electron beam and doubler spot welds during assembly. The Qz/PI overwrap is not fully cured in practice since the TDD antennas can become dimensionally unstable and fail when heated over 500° F. which prevents fully curing the overwrap. Furthermore, internal voids and surface cracks frequently form which necessitates the application of a 0.005 inch thick Epoxylite, an epoxy and solids filler adhesive sold by Epoxylite Corporation, 9400 Toledo Way, Irvine, Calif. 92713-9671, overwrap sealant, to seal the voids and surface cracks. However, the epoxylite overwrap sealant decomposes and burns in the range of 500°–600° F. This temperature restriction further prevents the full curing of the Qz/PI overwrap.

FIG. 1 illustrates the major sections of the AMRAAM 12 including the prior art aft fuselage 10 positioned between a GS forward fuselage 38 and an armament section 40. The GS forward fuselage houses a Terminal Seeker and radar transmitter unit (not shown). Correspondingly, the prior art GS aft-fuselage houses the Electronic Unit (EU) Assembly, the Inertial Reference Unit (IRU) and the TDD Electronics and Antennas (not shown). Bending loads generated by the forward and aft GS assemblies are transmitted through the GS aft-fuselage Missile Station (MS) "55", designated by numeral 44. The maximum bending moment at MS "55" is 1,015 lbs-inch which occurs as a result of a launch adapter unit (LAU)-92 eject launch. The forward pylon and eject launcher captive carry feature is provided by a forward hanger 46 and hook 48 located at the aft end of the armament section. Accordingly, all forward missile vibration loads which are generated from a captive carry aerodynamic buffet are transmitted through the aft-fuselage structure to the warhead hanger and hook assembly, namely, hanger 46 and hook 48. The GS aft-fuselage is designed to withstand missile free flight, eject launch, and captive carry fatigue loads and extreme Air-to-Air Missile (AAM) thermal environments with sufficient structural margin to ensure operation reliability. In addition, the GS aft-fuselage provides the EU Electromagnetic Interference (EMI) shielding and atmospheric isolation, the TDD antennas mounted on an external mounting surface, and thermal insulation for enveloping all of the electronic assemblies. As a result, the GS aft-fuselage is the most significant and complex vehicle fuselage assembly on AMRAAM, and the most expensive to fabricate.

Figure 5:
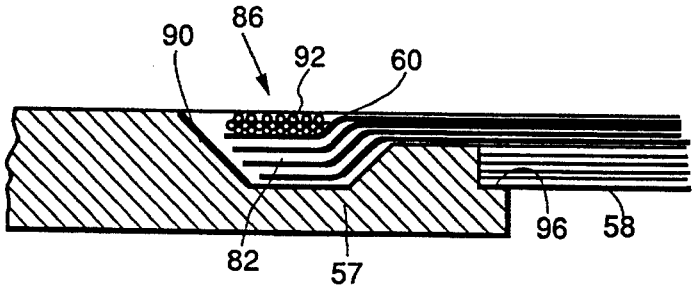
FIG. 5 is a somewhat diagrammatic sectional view depicting fiber orientation in constructing the trapped taper joint on the aft fastener ring structure of FIG. 4.
Figure 4:
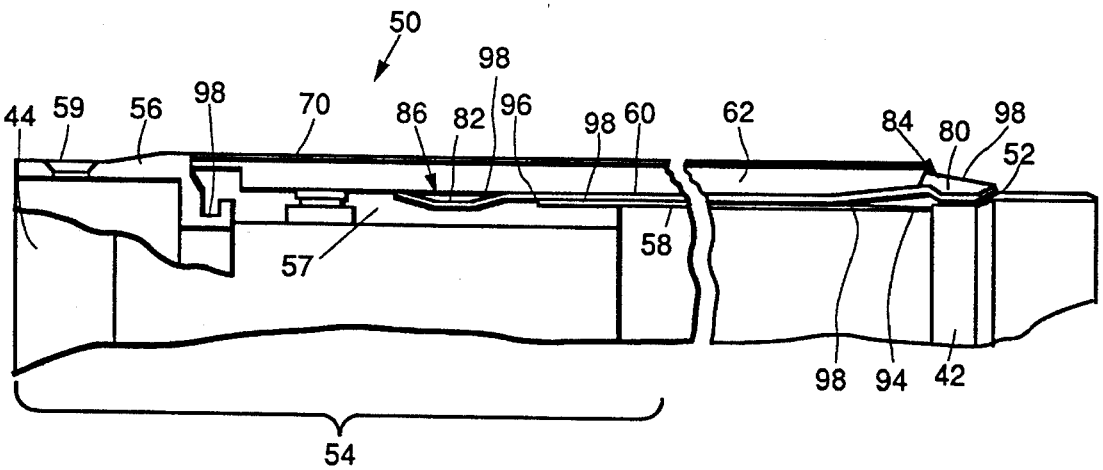
FIG. 4 is a partial centerline-sectional view of an integral missile antenna-fuselage assembly in accordance with the preferred embodiment of the present invention for use with the missile of FIG. 1.

Turning now to FIGS. 4 and 5, an Integral Missile Antenna Fuselage Assembly (IMAFA) 50 is shown in accordance with the present invention. IMAFA 50 is substituted for the prior art GS aft fuselage 10 where it is assembled into the missile 12. The antenna-fuselage assembly 50 is shown in cross-section in order to illustrate the various components utilized in constructing the assembly. A forward joint ring 52 and an aft joint ring-insert assembly 54 are simultaneously bonded to a near cylindrical-hydroformed titanium or corrosion resistant steel (CRES) structural liner. The aft joint ring-insert assembly 54 provides a fastener ring and is formed from a titanium joint ring 56 and an Resin transfer Molded (RTM) insert assembly 57 constructed from a RTM structure. Preferably, rings 52 and 56 are machined from titanium. A plurality of circumferentially spaced apart bolt holes 59 (only one of which is shown) are provided in each ring for fastening to respective adjoining missile sections. Alternatively, each ring is machined from corrosion resistant steel. Forward joint ring 52 is located at Missile Station (MS) "32", identified as numeral 42 in FIG. 1, on the AMRAAM missile, and aft joint ring assembly 54 is located in the vicinity of missile station (MS) "55", numeral 44, of the AMRAAM missile. The RTM composite insert assembly is fabricated preferably from a graphite fabric preform, injected with a Bismaleimide (BMI) resin which is integrally formed onto the aft joint ring assembly 54.

Preferably, a near cylindrical, hydroformed titanium liner 58 is simultaneously bonded to both the forward joint ring 52 and aft joint ring-insert assembly 54 with a structural adhesive. The liner 58 is preferably 0.015 to 0.020 inches thick and functions as a built-in filament winding mandrel which minimizes the cost of having to utilize a separate mandrel during construction of the aft fuselage assembly 50. Furthermore, the liner 58 provides the internal EU assembly with EMI and gas permeability shielding, and forms an integral, isotropic compression layer for the primary fuselage structure. Alternatively, the liner 58 can be formed from corrosion resistant steel (CRES).

A filament wound internal fuselage main structure 60 is formed over the liner 58 and portions of ring 52 and ring assembly 54. The internal fuselage main structure 60 provides primary load carrying structure for fuselage assembly 50, and is fabricated by filament winding Graphite/BMI pre-preg onto the resulting mandrel assembly formed by liner 58, ring 52 and ring assembly 54. Preferably, a structural adhesive is applied to the mandrel assembly prior to filament winding the pre-preg. The internal fuselage main structure 60 is then co-cured with four uni-directional Graphite/BMI doublers 62–65 which are axisymmetrically positioned on the external surface formed by structure 60 which assists to define four TDD antenna cavities 66–69 circumferentially spaced apart thereabout.

Figure 8B:
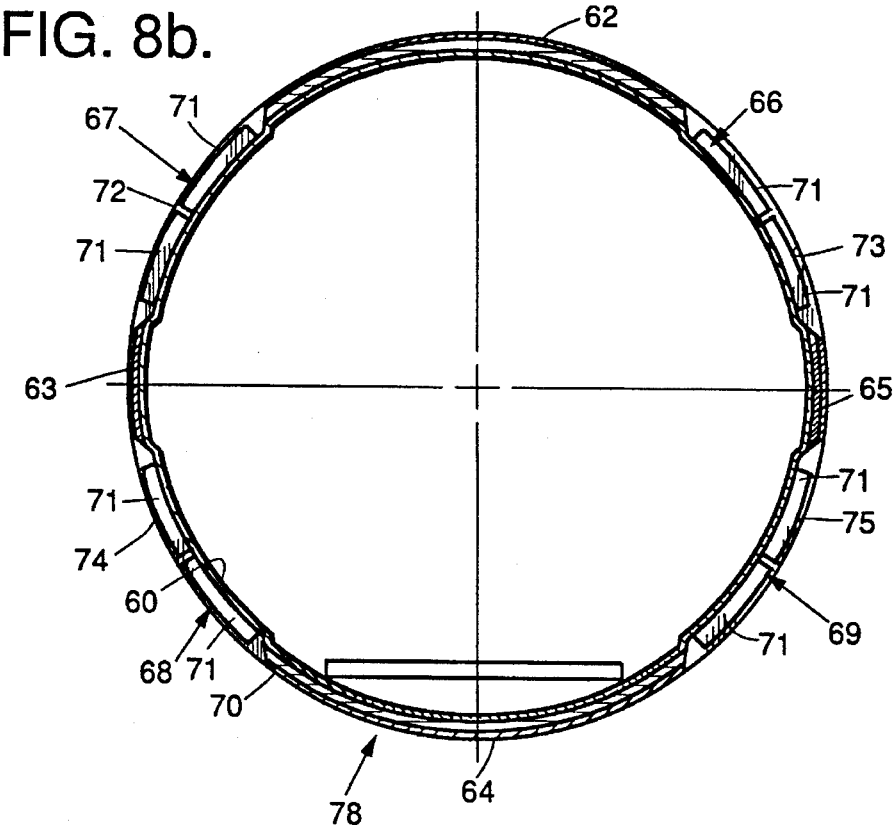

As shown in FIG. 8*b*, eight TDD antennas 71 are placed into the cavities 66–69, with two antennas per cavity. Four QZ/BMI antenna spacers 72–75 are added to enclose the antennas and form an external cylindrical surface. A radome overwrap, or QZ/BMI overwrap 70, is filament wound about the antenna spacers and doublers using a QZ/BMI pre-preg and integrally cured at 350° F. to the internal fuselage and antenna spacers, then post-cured at 475° F. to finish the IMAFA 50 prior to surface treatment and application of a polyurethane overcoat 78.

An innovative structural feature on the fuselage assembly 50 is the use of a trapped fiber, taper joint design 80, 82 at the aft and forward interfaces between the main structure 60 where it engages with the ring 52 and ring-insert assembly 54, respectively, as exhibited in FIG. 4. FIG. 5 schematically illustrates construction of a structural interface, namely fiber trap joint 82 formed on ring insert assembly 54 FIG. 5 schematically depicts fiber trap joint 82 which is formed in forward aft joint ring insert assembly 54. The internal fuselage main structure 60 is circumferentially hoop wound about the liner 58, and further wound into a fiber trap 90, comprising a radially inwardly extending circumferential recess. Alternatively, structure 60 can be formed from a cloth weave such as a fiberglass cloth, or graphite cloth. Preferably, at least one circumferential fiber 92 is subsequently circumferentially wound over the filament windings to trap them into the fiber trap 90 prior to wet-out or impregnation with a resin in which it is cured.

In order to facilitate winding of main structure 60, liner 58 is first adhesively retained to the forward joint ring 52 and the aft joint ring-insert assembly 54 at either end. A step-lap joint 94 is formed in joint ring 52 for receiving one end of the liner. A second step-lap joint 96 is formed in RTM insert 57 for receiving the opposite end of liner 58. Preferably, the liner is trapped and bonded onto each joint ring 52 and 54 with structural adhesive to form bond joint 84 and 86, respectively, in order to obtain compressive strength therethrough.

The filament wound structure 60 is then wound onto the liner 58 and inside the joint ring fiber trap joints 80 and 82 where further filament windings form circumferential fibers 92 which trap structure 60 therein. Alternatively, main structure 60 can be formed from a fabric weave, such as fiberglass cloth which is subsequently retained inside the fiber trap joints 80 and 82 with a wrapping of circumferential fibers 92 about the cloth. The wound structure 60 locks onto the rings 52 and 54 at fiber trap joints 80 and 82, respectively, to carry both compressive and tensile loads.

Preferably, a heat-cured structural adhesive 98 is first applied to all bond joint interfaces, namely, the joint between ring 56 and RTM insert 57, between ring 52 and liner 58, and between insert 57 and liner 58, as well as in the fiber traps 90. As a result, the primary composite structure adheres to the metallic liner and the tapered joint interfaces which augments the compressive load carrying capability of the liner. By combining the trap fiber, taper joint design with the liner step-lap joint, a more conservative configuration is provided for joining a main fuselage structure 60 to a joint ring 52 and a joint ring assembly 54. Therefore, an adequate design margin of safety is ensured which meets the severe eject launch and captive carry fatigue environments normally encountered with such a missile.

Figure 6:
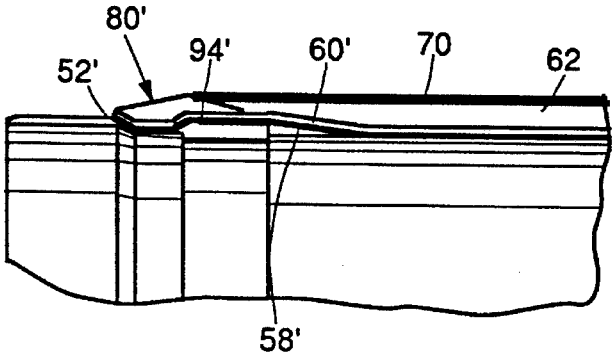
FIG. 6 is a partial vertical centerline-sectional view depicting an alternative construction for joining the titanium inner liner to the forward fastener ring than that already shown in FIG. 4.

FIG. 6 depicts an alternative construction for the forward joint on IMAFA 50. A modified forward joint ring 52' has a modified step-lap joint 94' which is adhesively bonded to a modified titanium liner 58. An internal fuselage main structure 60' is filament wound about the liner and joint ring, including a fiber trap joint 80' to bond the main structure 60' to the forward joint ring 52'. Subsequently, doublers 62, identical to those used in the preferred joint construction, are received over a main structure 60' afterwhich overwrap 70 is received and cured.

Figure 7:
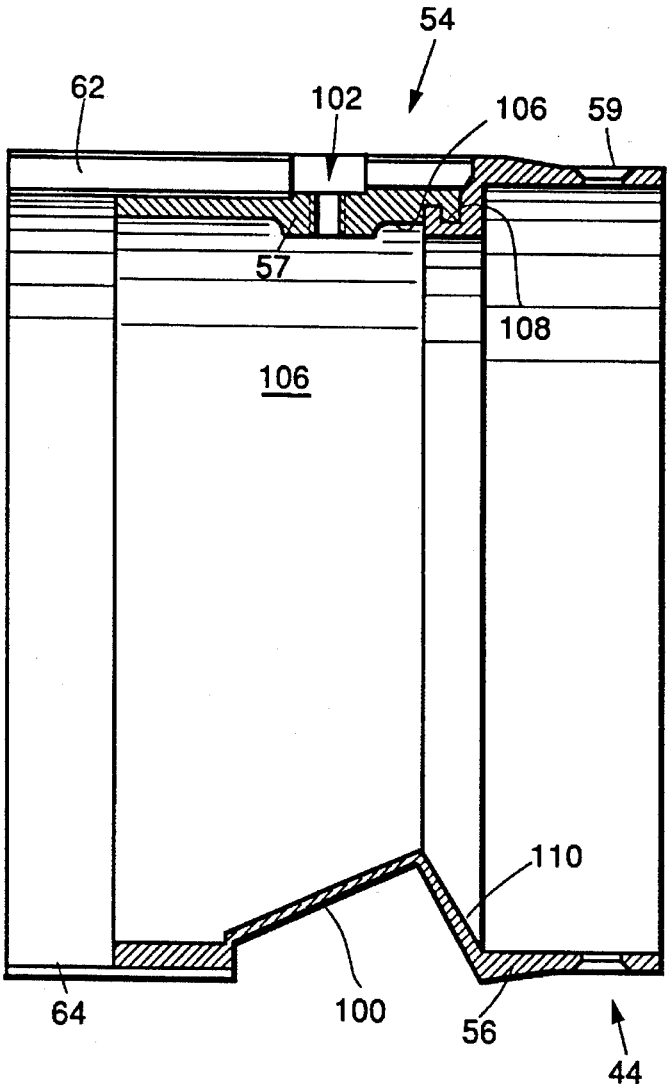
FIG. 7 is a vertical centerline-sectional view of the aft fastener ring including a Resin Transfer Molded (RTM) insert with an integral umbilical cavity.

FIG. 7 depicts a selected cross section of the ring/insert assembly 54, including Graphite/BMI resin transfer molded insert 57. An umbilical cavity 100 and a fill drain port 102 formed in insert 57 are shown in cross section. The umbilical cavity 100 allows connection of an electronic unit (EU) motherboard housed within the fuselage assembly 50 with a missile harness umbilical assembly 104 affixed to the missile exterior. As shown in FIG. 1, the umbilical assembly 104 extends from the missile GS 37, namely the rear portion of the aft fuselage 50, to the missile control section 41. Additional umbilical cavities (not shown) are provided on the armament section 40, propulsion section 39, and control section 41 for wiring to the umbilical assembly 104.

As shown in FIG. 7, the RTM insert 57 is thicker than the Graphite/BMI filament wound skin 60 which compensates for structural discontinuities normally encountered at a structural joint to provide a stiff, extremely stable Inertial Reference Unit (IRU) platform to MS "55", numeral 44. Numerous bosses, material standoffs, connector through holes, and fastener inserts are incorporated on the internal surface to mount the IRU, TDD Electronics and Coax Cable Assemblies inside the aft fuselage 50.

A metallic foil 106 is preferably co-cured on internal surface of RTM insert 57 to provide EMI and gas permeability shielding , and electrical ground continuity throughout the length of the aft fuselage 50. Perforations are provided in the foil 106 for through passage of bosses and access to umbilical cavities and sockets. Alternatively, surface sealants and electrically conductive paints can be substituted for foil 106.

The aft joint ring/insert assembly 54 is joined together with a mechanical locking joint which augments structural adhesive applied to the joined surfaces. A circumferential groove 108 is provided in the joint ring 56 into which the RTM insert is molded which traps the ring and insert together. Furthermore, groove 108 terminates in the region of the umbilical cavity 100 and a local groove 110 couples the ring and insert together in the region of the cavity 100. The mechanical joint formed therebetween functions mechanically similarly to the trapped fiber, taper fuselage joints 80 and 82. In each of these joints, catastrophic failure will only occur after the mechanically superior graphite fibers are fractured and break, instead of relying solely on the adhesive shear strength of a bonded joint configuration.

The IMAFA composite design for aft fuselage 50 avoids material stress concentrations and load path discontinuities associated with traditional fasteners. An attempt is made to incorporate uniform stress path characteristics in critical structural interfaces with composite material in order to eliminate any weak-link in an aerospace structure. Therefore, bond joints 84 and 86 at Missile Stations "32" and "55" have thin flanges, closely spaced countersunk holes 59 fully stressed in bearing and shear, and flathead screws torqued to the maximum allowable levels. Countersunk holes are position toleranced very tight to minimize stress concentration induced fatigue failures. Missile Stations "32" and "55" are also exposed to severe flight temperatures and a wide range of corrosive elements resulting from airborne captive carry. The forward and aft fiber trap joints 80 and 82 conflict with the design guidelines established within the industry for composite fastener applications. Therefore, aft fuselage 50 additionally incorporates the titanium, or CRES, ring structures 52 and 54 at Missile Stations "32" and "55" to meet the guidelines, as well as to form a mandrel on which structure 60 is formed.

The design of aft fuselage 50 is optimized to enhance structural reliability and material efficiency. Fuselage 50 has features designed to perform multiple roles or provide secondary features which augment their primary features. In use, fuselage 50 is completely sealed with adjacent missile sections and various connectors and fasteners, for example bolt holes 59, are sealed with a polysulfide sealant. The sealed fuselage, which houses missile electronics, is then pressurized with nitrogen to provide a zero humidity environment for the high power microwave electronics. In combination with the built-in shielding, the electronics are protected from both humidity and magnetic fields created by corona effects about the missile. FIG. 8-*b* depicts aft fuselage 50 in cross-sectional view at the location of the electronic unit (not shown). Likewise, the prior art aft fuselage 10 is also shown in FIG. 8-*a* at the same location. Doublers 62–65 and antenna cavities 66–69 are clearly visible in FIG. 8-*b*. The thickness and filament ply angles for the internal fuselage main structure 60 are preferably determined by structural Finite Element Model (FEM) analysis, preferably to match the natural vibration frequencies and mode shapes of the current GS aft-fuselage 10. Preliminary analysis has shown that a preferred composite laminate thickness and ply angle to be approximately 0.050 inches and ±20 degrees, respectively. The doublers are positioned between the internal fuselage 60 and Qz/BMI overwrap 70 to provide fuselage stiffness during eject launch, antenna cavity depth, and insulation for the internal fuselage 60 from missile flight and captive carry thermal transients. Radome overwrap 70 is integrally cured to the doublers and antenna spacers to encapsulate the TDD antennas from atmospheric humidity and form a cylindrical sandwich structure for maximum load carrying capability. The radome overwrap 70 will augment the bending inertia of the internal fuselage 60 to minimize moment induced stresses during captive carry buffet and maximize fatigue life.

Previous composite missile airframe fabrication experience lead to the selection of BMI resin in constructing aft fuselage 50. Initial work with glass reinforced BMI showed high temperature capability and low cost. Hexcel F650 BMI resin presently appears to show the best high temperature capabilities. Alternatively, Hexcel F655 toughened BMI and YLA RS-3 Poly Cyanate were found to be acceptable resins for the internal fuselage 60 which improve damage tolerance and fatigue durability.

It is to be understood that the invention is not limited to the exact construction illustrated and described above, but that various changes and modifications may be made without departing from the spirit and scope of the invention as defined in the following claims.

Thus, while this invention has been disclosed herein in combination with particular examples thereof, no limitation is intended thereby except as defined in the following claims. This is because a skilled practitioner recognizes that other applications can be made without departing from the spirit of this invention after studying the specification and drawings.

What is claimed is:

1. An assembly for use in an armament missile constructed from a plurality of joined-together sections, said assembly comprising:

a missile fuselage tube constructed of a composite material having reinforcing fibers impregnated with resin;

a fastener ring having an outer rim portion with a radially inward extending circumferential recess formed therein for receiving at least ends of the fibers;

circumferential means surrounding the ends of the fibers to secure the ends of the fibers within said rim portion recess; and said resin further impregnating the ends of the fibers and the circumferential means to bond the tube to the ring.

2. The structural joint of claim 1 wherein said resin comprises Bismaleimide (BMI) resin.

3. The structural joint of claim 2 wherein said reinforcing fibers and said circumferential means comprise graphite fibers.

4. An aft fuselage assembly for use in constructing a multiple-section armament missile, the assembly comprising:

a first fastener ring having an outer rim portion with a radially inward extending circumferential recess formed therein;

a second fastener ring having an outer rim portion with a radially inward extending circumferential recess formed therein;

a liner extending between said first and second fastener rings which retains said first and second rings in spaced-apart relation, said liner affixed to said first fastener ring at a first end and said second fastener ring at a second end; and a filament wound main structure provided by at least one nested enforcing fiber received on said liner and radially inwardly received in each of said rim portion recesses, said fiber thereafter wetted-out with resin to form a cured resin matrix laminate structure which is recess trapped on said first and second fastener rings at either end.

5. The assembly of claim 4 further comprising at least one doubler received on an exterior surface of said main structure, at least one antenna spacer which is constructed and arranged to provide at least one axisymmetric antenna cavity therein and which cooperates with said doubler to define a circumferential outer surface, and a quartz overwrap further provided thereabout, wherein said overwrap is wetted-out with resin and heated to form a cured resin matrix laminate structure.

6. The assembly of claim 5 wherein said doubler comprises a pressure-cured graphite composite.

7. The assembly of claim 5 wherein said overwrap comprises a filament wound quartz pre-impregnated Bismaleimide (BMI) resin composite.

8. The assembly of claim 5 further comprising a connector through-hole provided in one of said fastener rings communicating between a liner interior and said antenna cavity, when assembled, and providing a passage for passing antenna cables therethrough.

9. The assembly of claim 4 wherein one of said fastener rings comprises a metal ring with an outer rim portion having a radially inward extending circumferential recess formed therein and a resin transfer molded composite insert assembly in-place molded to said metal ring within said circumferential recess of said metal ring so as to be recess trapped for rigid attachment therebetween.

10. The assembly of claim 8 further comprising an umbilical cavity provided in one of said fastener rings and said main structure for communicating between said liner interior and an exterior of the aft fuselage assembly, wherein provision is made for through-passage of antenna cables in a harness umbilical retained on an armament missile exterior.

11. The assembly of claim 4 wherein at least one of said fastener rings comprises a metal bolt ring having a radially inwardly extending circumferential outer groove and a separate circumferential composite rim structure which is affixed to said bolt ring by forming said rim in entrapped engagement with said bolt ring outer groove, wherein said rim portion recess is provided in said composite rim structure.

12. The assembly of claim 4 wherein said liner comprises a metal tube.

13. The assembly of claim 12 wherein said metal tube comprises steel.

14. The assembly of claim 12 wherein said liner comprises titanium which provides EMI and gas permeability shielding, and electrical ground continuity therealong.

15. The assembly of claim 12 wherein said liner comprises a metal tube which provides leakage prevention and EMI shielding, and metal foil is co-cured on an internal surface of said composite rim structure for providing further EMI and gas permeability shielding, and electrical ground continuity throughout the aft fuselage assembly.

16. The assembly of claim 15 wherein said liner comprises titanium.

17. An armament missile constructed from a plurality of assembled components comprising:

a first missile section;

a second missile section;

a third missile section disposed between said first and second missile sections comprising a first fastener ring having an outer rim portion with a radially inward extending circumferential recess formed therein, a second fastener ring having an outer rim portion with a radially inward extending circumferential recess formed therein, a liner extending between said first and second fastener rings which retains said first and second rings in spaced-apart relation, said liner affixed to said first fastener ring at a first end and said second fastener ring at a second end, and a filament wound main structure provided by at least one nested enforcing fiber received on said liner and radially inwardly received in said rim portion recesses, said fiber thereafter wetted-out with resin to form a cured resin matrix laminate structure which is recess trapped on said first and second fastener rings at either end.

18. The armament missile of claim 17 wherein one of said fastener rings comprises a metal ring with an outer rim portion having a radially inward extending circumferential recess formed therein and a resin transfer molded composite insert assembly in-place molded to said metal ring along said circumferential recess so as to be recess trapped for rigid attachment therebetween.

19. The armament missile of claim 17 wherein a plurality of bolt holes are provided in said second fastener ring for fixing said third missile section to said adjoining second missile section.

* * * * *